US007159433B2

(12) United States Patent
Seidel

(10) Patent No.: US 7,159,433 B2
(45) Date of Patent: Jan. 9, 2007

(54) METHOD AND DEVICE FOR COOLING AND LUBRICATING ROLLERS ON A ROLLING STAND

(75) Inventor: Jürgen Seidel, Kreuztal (DE)

(73) Assignee: SMS Demag AG, Düsseldorf (DE)

( * ) Notice: Subject to any disclaimer, the term of this patent is extended or adjusted under 35 U.S.C. 154(b) by 426 days.

(21) Appl. No.: 10/481,927

(22) PCT Filed: Jun. 25, 2002

(86) PCT No.: PCT/EP02/07030

§ 371 (c)(1),
(2), (4) Date: Dec. 23, 2003

(87) PCT Pub. No.: WO03/002277

PCT Pub. Date: Jan. 9, 2003

(65) Prior Publication Data

US 2004/0217184 A1 Nov. 4, 2004

(30) Foreign Application Priority Data

Jun. 28, 2001 (DE) ..... 101 31 369

(51) Int. Cl.
*B21B 27/06* (2006.01)

(52) U.S. Cl. ..... 72/201; 72/41; 72/43; 72/202; 72/236

(58) Field of Classification Search ..... 72/7.1, 72/11.1, 11.3, 30.2, 41, 43, 200, 201, 202, 72/236

See application file for complete search history.

(56) References Cited

U.S. PATENT DOCUMENTS 4,272,976 A * 6/1981 Pizzedaz ..... 72/45
4,392,367 A * 7/1983 Bald ..... 72/11.3
4,497,180 A * 2/1985 Graham ..... 62/63
4,653,303 A 3/1987 Richard
4,671,091 A * 6/1987 Atack et al. ..... 72/45
5,694,799 A * 12/1997 Wolpert et al. ..... 72/43
5,768,927 A * 6/1998 Kajiwara et al. ..... 72/10.1
5,799,523 A * 9/1998 Seidel et al. ..... 72/9.3
6,006,574 A * 12/1999 Armenat et al. ..... 72/201

OTHER PUBLICATIONS

Patent Abstracts of Japan, vol. 1995, No. 06, Jul. 31, 1995 & JP 07 068310 A (Kawasaki Steel Corp) Mar. 14, 1995.
Patent Abstracts of Japan, vol. 2000, No. 01, Jan. 31, 2000 & JP 11 290932 A (Nippon Steel Corp), Oct. 26, 1999.
Patent Abstracts of Japan, vol. 1995, No. 06, Jul. 31, 1995 & JP 07 075809 A (Sumitomo Metal Ind Ltd) Mar. 20, 1995.
Patent Abstracts of Japan, vol. 015, No. 002, (M-1065) , Jan. 7, 1991 & JP 02 255206 A (Sumitomo Light Metal Ind Ltd), Oct. 16, 1990.
Database WPI, Section Ch, Week 199348, Derwent Publications Ltd., London & SU 1 761 322 A (DNEPR Metal Inst), Sep. 15, 1992.

* cited by examiner

*Primary Examiner*—Ed Tolan
(74) *Attorney, Agent, or Firm*—Friedrich Kueffner

(57) ABSTRACT

The invention relates to a method and a device for cooling and/or lubricating rollers, in particular the working rollers (2, 3) on a rolling stand and a rolled strip (1), rolled between the above rollers and transported onwards, using water in the form of spray jets (4, 5) as cooling medium and oil, oil/water mix, oil/water mix, oil/air/water mix or grease mixtures as lubricant. In order to improve the lubricating and cooling effects, a combined application of super-cooling the strip and roller surfaces and roller lubrication on the input side of the stand is disclosed, in which both media, water and lubricant, are separately fed to the rollers (2, 3) and the rolled strip and applied to the roller surface at different application points. Separate reservoirs for water and lubricant and separate lines to the spraying bar (11) for water and the spraying bar (12) for the lubricant are provided.

12 Claims, 3 Drawing Sheets

METHOD AND DEVICE FOR COOLING AND LUBRICATING ROLLERS ON A ROLLING STAND

This application is a 35 USC 371 of PCT/EP/02/07030 filed Jun. 25, 2002.

The invention concerns a method for cooling and/or lubricating rolls, especially work rolls of a rolling stand, and rolling stock passed between the rolls during the rolling operation.

Especially in the rolling of thin slabs to small final thicknesses, it is necessary to achieve a high draft per pass in the individual rolling stands. This results in extraordinarily high mechanical as well as thermal loads on the rolls, especially the work rolls. This causes surface deterioration of the rolls with increasing number of strips rolled, especially in the front rolling stands. This surface deterioration takes the form of increasing roughness and even "scaling" of the rolls, in which the oxide layers become detached from the roll in some places. The resulting irregular roll roughness finally leads to scale being rolled into the surface of the strip, which likewise adversely affects the quality of the strip surface.

At extremely high drafts per pass, the work rolls may also vibrate, i.e., torsional vibration of the two work rolls relative to each other may occur.

Good roll cooling at the strip run-in and run-out sides of the stand can limit the roll temperature and thus the geometric expansion of the rolls, but it cannot prevent the high thermal loads in the roll gap and thus the aforementioned problems.

In regard to the state of the art, the document DE 41 34 599 C1 describes a measure for counteracting the high thermal load in the roll gap by subcooling the strip surface and roll surface shortly before the roll gap. When the surface layers of the rolls and rolling stock are subcooled, there is less heat flow into the roll. However, to achieve a sufficient cooling effect with this method, a relatively large amount of water is required, and the effect is inadequate when large thickness reductions are involved.

According to another method described in the document EP 09 08 248 A2, roll scaling and the rolling in of scale can be avoided or prevented by lubricating the rolls.

Another application method that has become established consists in spraying the rolls before the roll gap with an oil-water mixture. In this method, a small amount of water serves as a medium for the oil. The addition of the lubricant is designed to lower the coefficient of friction and in part to produce a thin interfacial layer of oil, which protects the roll from wear.

For reasons of economy and environmental protection, the admixture of oil to produce an oil-water mixture, e.g., in the cooling bar in accordance with the document DE 41 34 599, is undesirable when large amounts of water are used. This is also due to the fact that, when large amounts of water are used, correspondingly large amounts of oil would be necessary for the mixing ratio to remain optimum and a lubricating effect to be achieved. For this reason, a separate, small lubricating bar with a small amount of water as the medium is often used to apply the oil.

However, even with this method, the result with respect to roll scaling and roll roughness is by no means satisfactory at high drafts per pass. Only a significant damping of the vibration is observed.

The document EP 0 69 07 66, which pertains to a different field of technology, describes the lubrication and cooling of workpieces in machining processes, in which at least two immiscible fluids are supplied to the workpieces, namely, a substrate for reducing the friction between the cutting edge and the workpiece and a substrate for cooling the cutting edge and workpiece, such that the two substrates are stored separately from each other and are conveyed by separate lines to an application device, from which they are sprayed onto the workpiece to be machined.

In the specification, it is stated that the method and equipment of the invention make it possible to achieve a significant increase in the lubricating and cooling effect and to maintain the means necessary for this and the expenditures of material, energy, and equipment within very narrow, economic limits.

It is further claimed that, due to the application of lubricant and coolant in separate places on the tool and due to the resulting lubricant film of extremely high adhesive strength and shear strength, a significantly improved lubricating effect and thus reduced friction on the workpiece and tool and cutting with less frictional heat are achieved. At the same time, due to the resulting more favorable cooling conditions, the quality of the machined surfaces is improved, the power consumption of the machine is lowered, and the service lives of the tools are increased.

Furthermore, a very similar method for lubricating and cooling cutting edges or workpieces is described in DE 43 09 134 A1, according to which, during a relative movement of the cutting edge and workpiece, first the lubricant is sprayed, and only then the coolant is sprayed in the direction of the machining region, according to the required degree of cooling of the workpiece and tool. To this end, the temperature of a cutting edge or a tool or a workpiece is determined, and the delivery rate of one of the two fluids is adjusted on the basis of the temperature that has been determined.

The document JP-07[1995]-068,310 A describes a water cooling device for cooling the surface of rolling stock and a device for feeding rolling oil, which are separated by a water wiper. Both devices are arranged close to the roll gap between an upper and a lower roll, and the rolls are lubricated by the rolling oil device to reduce the thermal load, which in turn results in reduced heat generation and rolling load due to reduction of the coefficient of friction. As a result, the roll is freed of the rough surface, and, because the temperature of the surface of the rolling stock is lowered, the development of secondary scaling is eliminated, and scale scratch marks are avoided.

The document JP-11[1996]-290,932 A describes cooling devices, which are arranged directly adjacent to the roll gap between the upper and lower work rolls with upper and lower backup rolls, for cooling the rolling stock and rolling oil devices and cooling devices, which are separated by water wipers. Preferably, lubricant devices for mixing lubricating oil with cooling water are provided. The flow rate of the cooling water for cooling the upper and lower surface of the rolling stock by means of the nozzles on the run-in side of the rolling stand is set at 75 m/sec.

The document JP-07[1995]-075,809 A describes the use of highly basic metal salt sulfonate for application to the surface of at least one work roll in connection with the high-speed rolling of steel with a high carbon content. To achieve more reliable application and adhesion to the surface of the roll, a sulfonate application and shielding device is provided, which is arranged between a water wiper and a lubricant application device below the cooling water spray device on the run-in side of the rolls. This means that the application of sulfonate occurs separately from the generally used lubricant.

The document SU-1 761 322 A describes the application of a lubricant and coolant to roll surfaces. The lubricant consists of saponified fatty acids. The advantage is that the process increases the abrasion resistance and the quality of the rolled strip by a factor of 2.5 to 3.4.

Proceeding on the basis of the state of the art described above, the objective of the present invention is to improve the roll cooling and roll lubrication in a high-load rolling stand and to make more economic use of lubricants.

To achieve this objective with a method of the type specified in the introductory clause of claim 1 for the cooling and lubrication of rolls, especially the work rolls of a rolling stand, and rolling stock passed between the rolls during the rolling operation, the invention provides that, depending on boundary conditions and requirements, either only the lubricant is applied, or only the rolling stock cooling system is activated.

This provides the great advantage of optimum use of both the lubricating and cooling effect of the two media water and lubricant and thus, at the same time, reduction of the energy and power consumption due to the minimization of the coefficients of friction on the rolls. The ground surface of the roll withstands even the highest loads. The previously observed material scaling of the rolls is prevented. The surface of the rolling stock remains optimally smooth. Scale inclusions and chatter marks on the strip surface are eliminated.

In a further improvement of the invention, it is proposed that water jets be applied on the upper side and/or the underside of the strip on the run-in side before the roll gap, such that the water jets are preferably directed against the strip, and that the lubricant be applied above and below in one region each of the rolls on the run-in side before (as viewed in the direction of rotation of the rolls) the regions in which the water is applied. In accordance with the invention, water is thus applied directly to the upper side and/or underside of the strip before the roll gap, with the water jets being directed mainly towards the strip to prevent as much as possible the previously applied lubricating oil from being washed off. Nevertheless, the orientation of the water jets in accordance with the invention leads indirectly to additional cooling of the surface of the rolls.

In accordance with another proposal of the invention, to optimize the combined use of cooling of the strip surface and roll surface and lubrication of the rolls, the roll cooling system on the run-in side is deactivated during active lubrication, and the excess water from the run-in side is used to intensify the cooling of the rolls on the run-out side. The additional intensive cooling of the rolls on the run-out side is effected exclusively with water spray jets. When the lubrication is not active, the roll cooling system on the run-in side is activated.

In a variation of the invention, water jets can be sprayed onto the strip on the run-in side as small a distance as possible before the roll gap with a jet direction against the strip flow direction, and in this case as well, the application sites for water and lubricant must be separated.

In regard to equipment for the cooling and/or lubrication, in accordance with the invention, of rolls, especially the work rolls of a rolling stand, and rolling stock passed between the rolls during the rolling operation with the use of water in the form of spray jets as the cooling medium and the use of a lubricant, it is provided that the media, i.e., water and lubricant, are assigned separate reservoirs and separate lines to application devices for water and application devices for lubricant.

In one embodiment of the equipment, it is proposed that, to separate the application sites of the two spray bars for water and lubricant from each other, a lubricant spray device for the upper roll be placed above a wiper, and a lubricant spray device for the lower roll be placed below a wiper, so that the wipers that are already present anyway in rolling stands can be exploited for this purpose. In addition, a deflection plate or water distribution plate for the spray jets, which is directed towards the rolling stock, can be installed below the upper wiper on the run-in side, and another can be installed above the lower wiper on the run-in side, for the purpose of distributing the spray water on the rolling stock as uniformly as possible and without streaking.

To further refine the equipment of the invention, a deflection plate or water distribution plate for the spray jets, which is directed towards the rolling stock, can be installed below the upper wiper on the run-in side, and another can be installed above the lower wiper on the run-in side, for the purpose of distributing the spray water on the rolling stock as uniformly as possible and without streaking.

There may be one plate on each side, or two deflection plates may be provided on each side, which focus the water jet like a funnel to produce the best possible uniformity of the coolant jet over the width of the rolling surface.

Alternatively, a so-called water curtain may be used for cooling the strip, for example, as described in DE Patent 28 04 982, in which the water emerges from a rectangular slot and is sprayed against the strip. In this regard, an optimized embodiment of the water curtain provides that the aperture width of the discharge slot can be adjusted, so that the most favorable possible conditions can be realized, e.g., for cleaning purposes or variable amounts of water.

Application of the lubricant above the upper wiper and below the lower wiper makes it possible to recover the lubricant after it has been applied. This leads to another refinement of the lubricant application in accordance with the invention, in which the lubricant sprayed onto the roll is confined in a shielding "shell" and is drained off to the rear or to the side, so that the lubricant can be removed or reprocessed or disposed of separately from the other cooling media.

Details, features and advantages of the invention are apparent from the following explanation of an embodiment of the invention, which is shown schematically in the drawings.

Figure 1:
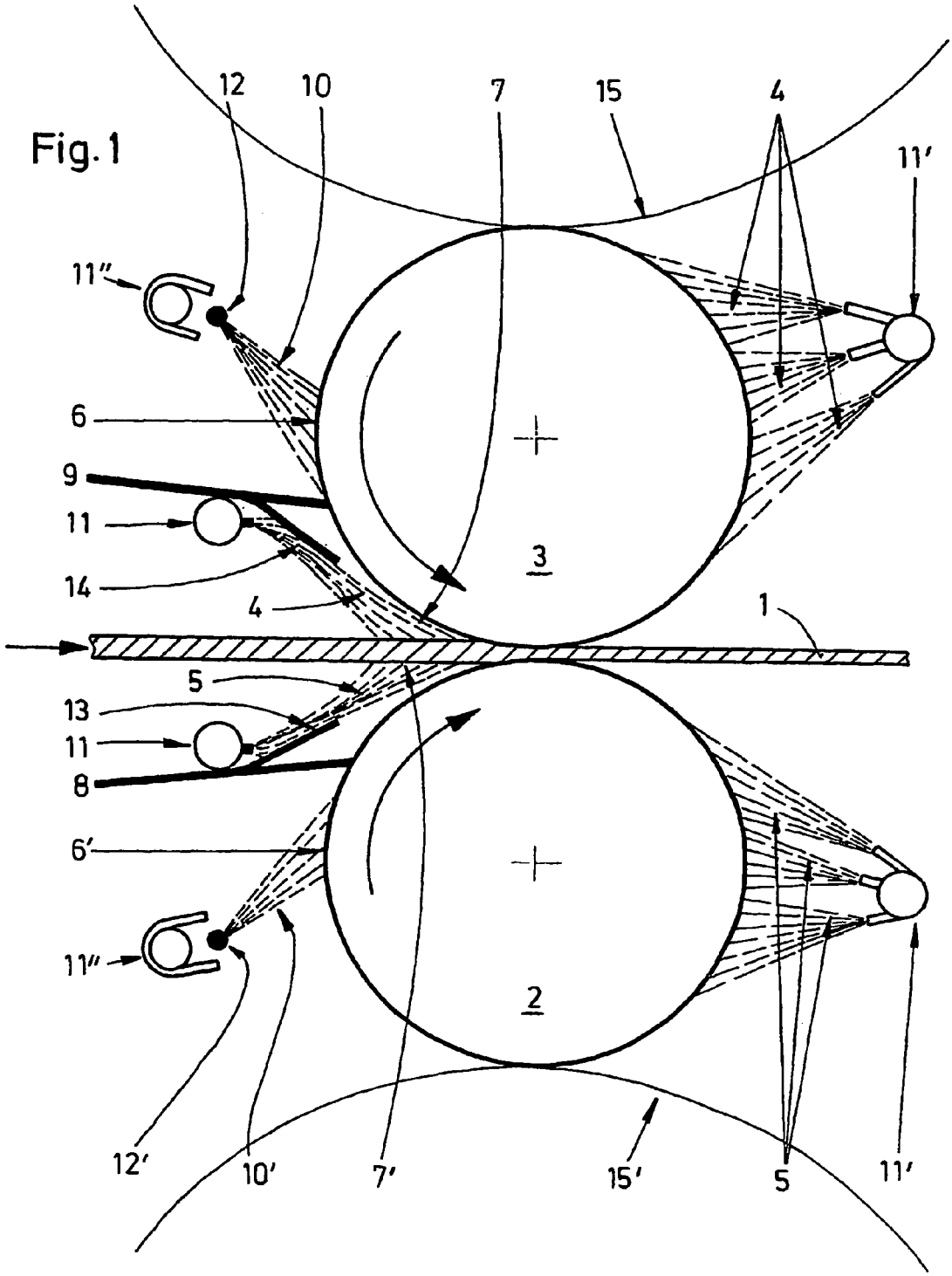
FIG. 1 shows a side view of the roll cooling and roll lubricating equipment with schematically indicated spray jets of water and lubricant.

In accordance with FIG. 1, rolling stock 1 is reduced in thickness by about 50% in a single pass between the work rolls 2, 3 of a rolling stand, which is not shown in further detail. Successive rolling stands, which are also not shown, have more or less equally large drafts. To limit both the high mechanical loads and the high thermal loads, and to prevent deterioration of the roll surfaces with increasing number of strips rolled, the combined cooling of the strip surface and lubrication of the roll surface is employed with the following measures.

In the cooling and lubricating equipment shown here, the media, i.e., water and lubricant, are each assigned to separate reservoirs (not shown) and separate feed lines (not shown), which lead to the application devices 11, 11', 11" for water 4, 5 and to separate application devices 12, 12' for lubricant 10, 10'. These application devices are generally designed as lubricant and coolant spray bars. The lubricant spray bar 12 on the upper work roll 3 is arranged above a wiper 9. The lubricant spray bar 12' on the lower work roll 2 is arranged below the wiper 8. The upper water spray bar 11 for cooling the upper side of the strip 1 is arranged below the wiper 9, and the lower water spray bar 11 for cooling the underside of the rolling stock 1 is arranged above the wiper 8. Water spray jets 4, 5 are directed by the water spray bars 11 onto the surfaces of the rolling stock before the roll gap of the work rolls 2, 3. The water spray jets 4, 5 are deflected by the deflection plate 14 above the rolling stock 1 and the deflection plate 13 below the rolling stock 1 in such a way that they impinge on the strip as close as possible to the region of the roll gap on the run-in side, where they hit the application regions 7, 7' for the direct cooling of the rolling stock 1 and the indirect cooling of the work rolls 2, 3 to achieve the optimum effect.

Figure 3:
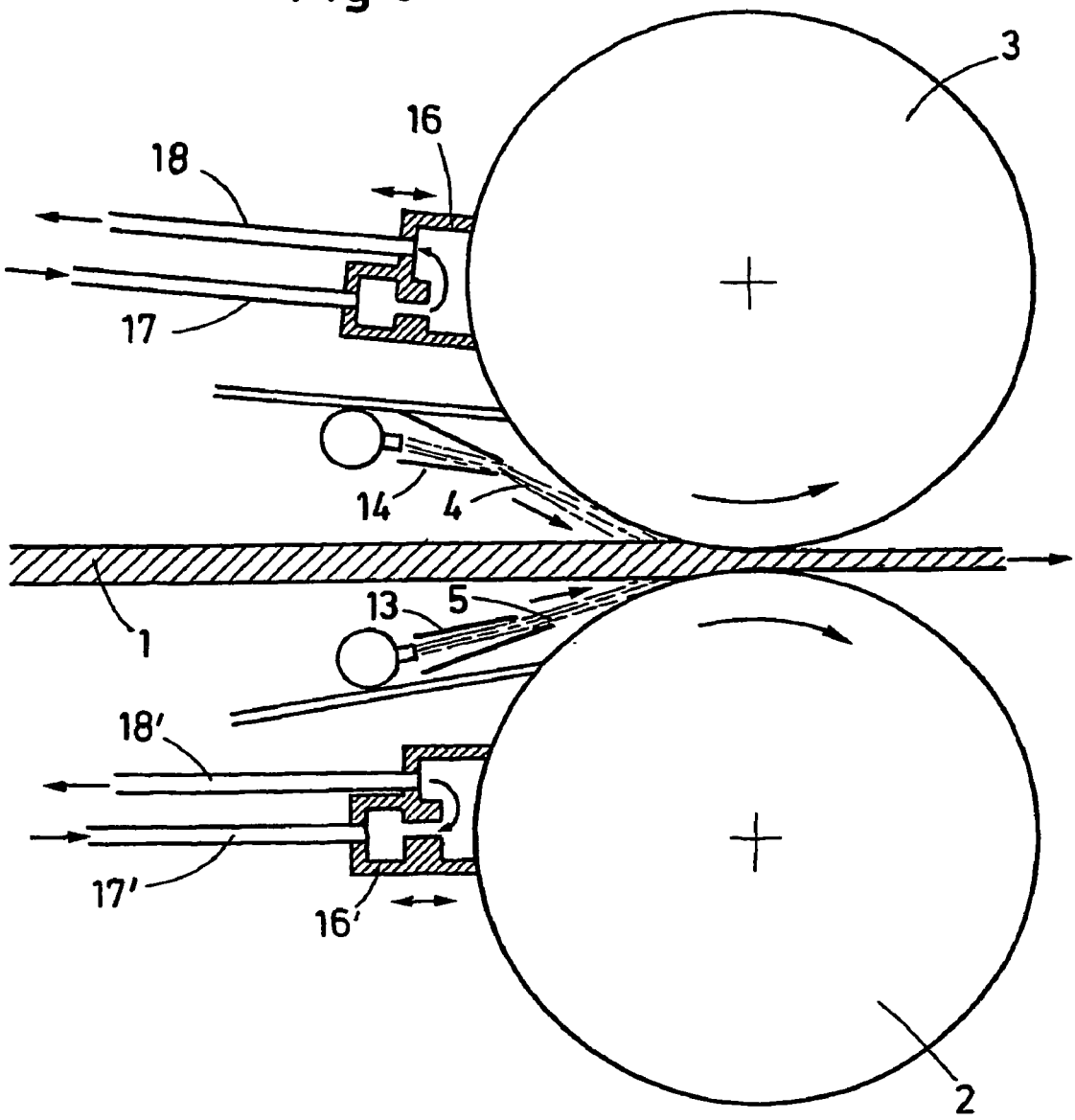
FIG. 3 shows an alternative system of deflection plates and shielding shells for separate removal of the lubricant.

An alternative arrangement of the deflection plates is shown in FIG. 3. In this case, a water jet is focused like a funnel by two deflection plates to achieve the best possible uniformity of distribution of the jet over the rolling width.

Lubricant spray bars 12, 12' are provided to produce lubricant spray jets 10, 10'. To produce a lubricant film with optimum adhesive strength, the lubricant is applied to the largely water-free region of the surface of the work rolls. In this regard, the oil spray 10, 10' is applied at a site immediately before the wipers 8, 9 (as viewed in the direction of rotation of the rolls).

To produce further intensive cooling of the work rolls 2, 3, additional water spray bars 11' are arranged on the run-out side of the work rolls, from which exclusively water spray jets 4, 5 are directed against the surfaces of the rolls. The cooling water from the work roll cooling system 11' on the run-out side is shielded by the backup rolls 15, 15', so that the regions 6, 6' remain dry.

The lubricating and cooling spray bars 11, 12 can be controlled in such a way that the water cooling system 11" on the run-in side is deactivated during active lubrication, and the roll cooling system 11" is activated when the lubrication is not active. If the roll cooling system 11" on the run-in side is deactivated, excess water is used to intensify the roll cooling on the run-out side, i.e., it is fed to the cooling spray bars 11' located on the run-out side. It is also possible to switch over from combined roll cooling and roll lubrication with separate application points to exclusive water cooling, in which case all of the water spray bars 11, 11', 11" are activated, and the lubricant spray bars 12 are all deactivated.

Figure 2:
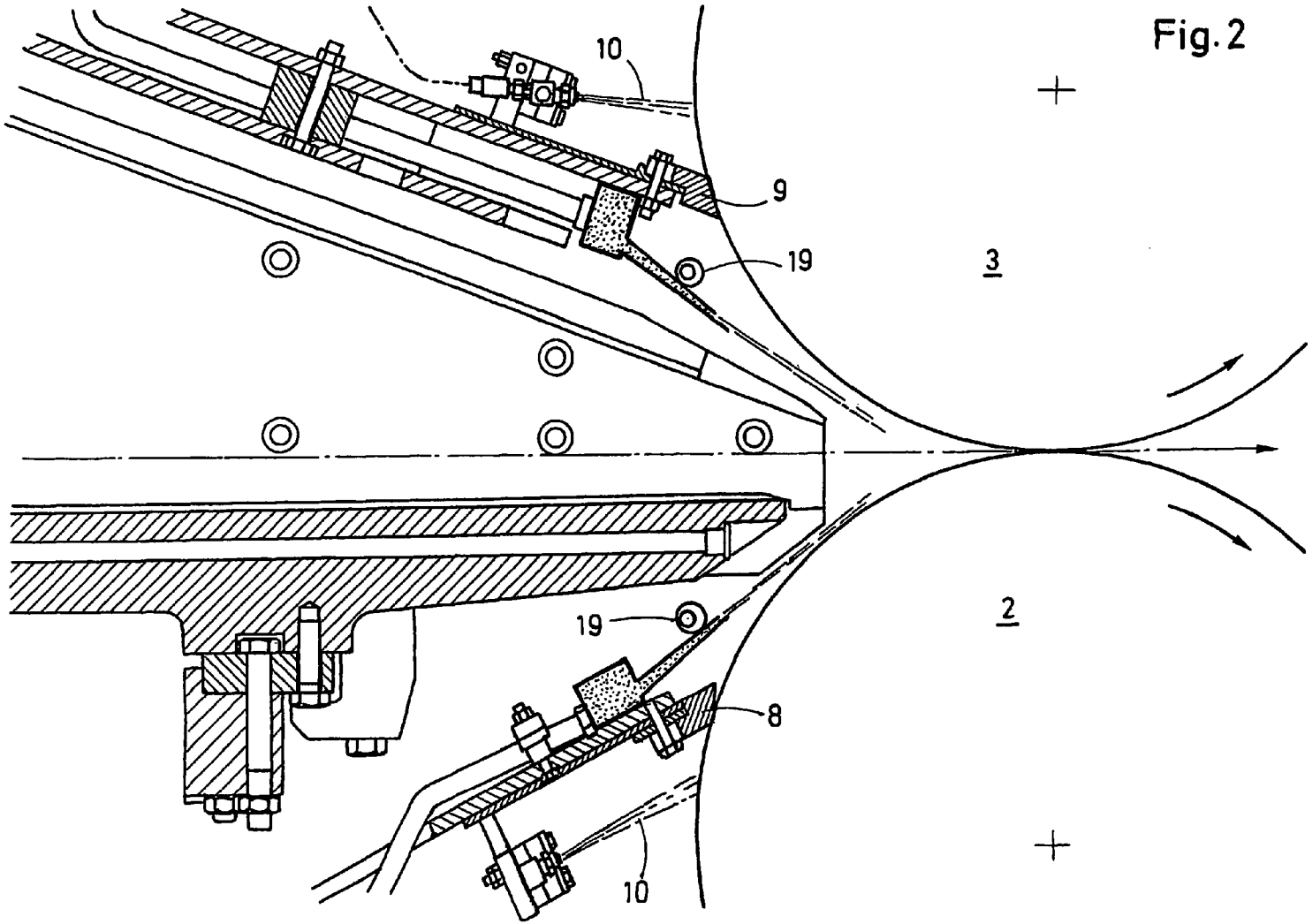
FIG. 2 shows another system of jets for cooling the strip immediately before the roll gap with the use of a water curtain.

Another refinement of the system is shown in FIG. 2 for strip cooling directly before the roll gap. In this case, water 4, 5 emerges from a rectangular slot and is sprayed against the strip 1. An cam adjusting device 19, which can be manually operated or driven by a motor, is used for continuous adjustment of the slot or aperture width by turning the shaft.

In the refinement of the lubricant supply system shown in FIG. 3, lubricant 10, 10' is sprayed onto the work roll inside a shielding shell 16, 16', so that the lubricant flows past the roll and is then returned. The swivelling shielding shell has a feed line 17, 17' for the lubricant 10, 10' and a discharge line 18, 18'.

Depending on the design, the lubricant may also be removed from the side and then collected. If necessary, this allows reprocessing or disposal of the lubricant. This system prevents lubricant from accumulating in the coolant circulation.

The system of lubricating and cooling spray bars for lubricant and water spray jets that is shown in FIGS. 1 to 3 and the method for cooling and lubricating the work rolls of a rolling stand that is realized with the new system are not limited to the specific embodiment illustrated here, but rather also include other variants that conform to the invention.

| List of Reference Numbers | |
|---|---|
| 1 | rolling stock |
| 2 | lower work roll |
| 3 | upper work roll |
| 4 | upper water spray jet |
| 5 | lower water spray jet |
| 6 | lubricant application region |
| 7 | water application area |
| 8 | lower wiper |
| 9 | upper wiper |
| 10 | lubricant |
| 11 | water application device |
| 12 | lubricant application device |
| 13 | lower deflection plate |
| 14 | upper deflection plate |
| 15 | backup roll |
| 16 | shielding shell |
| 17 | feed line |
| 18 | discharge line |
| 19 | cam adjusting device |

The invention claimed is:

1. Method for cooling and/or lubricating work rolls (2, 3) of a rolling stand, and rolling stock (1) passed between the rolls during the rolling operation, with the use of water in the form of spray jets (4, 5) as the cooling medium and the use of oil, an oil-air mixture, an oil-water mixture, or an oil-water-air mixture, or grease or a grease-medium mixture as the lubricant, in which the water and lubricant are supplied separately to the rolls and the rolling stock (1) and are applied to the roll surface and the rolling stock surface at different application sites on the run-in side of the rolling stand, and the lubricant is applied to largely water-free regions of the surface of the rolls to produce a film with the greatest possible adhesive strength, such that application regions (6, 7; 6', 7') for the application of the two media, water and lubricant, are separated from each other by wipers (8, 9), wherein, depending on boundary conditions and requirements, either only a lubricant is applied, or only the rolling stock cooling system is activated.

2. Method in accordance with claim 1, wherein water jets (4, 5) are applied (7, 7') on the upper side and/or the underside of the strip on the run-in side before the roll gap, such that the water jets (4, 5) are preferably directed against the strip (1), and that the lubricant (10, 10') is applied above and below in one region each (6, 6') of the rolls (2, 3) on the run-in side before (as viewed in the direction of rotation of the rolls) the regions (7, 7') in which the water is applied.

3. Method in accordance with claim 1, wherein additional intensive cooling of the rolls (2, 3) on the run-out side of the rolling stand is effected exclusively with water spray jets (4, 5).

4. Method in accordance with claim 1, wherein the lubricant(10) is applied to the rolls at a point immediately before the wipers (8, 9), as viewed in the direction of rotation of the rolls, and the cooling medium (4, 5) is applied to the rolling stock at a point as short a distance as possible before the roll gap.

5. Method in accordance with claim 1, wherein to achieve the most uniform possible application of water to the rolling stock (1), the water spray jets (4, 5) are deflected towards the strip (1) by deflection plates or water distribution plates, one arranged above the strip and the other below the strip.

6. Method in accordance with claim 1, wherein a water curtain, which emerges from a rectangular spray jet orifice and is directed against the strip (1), is used to cool the rolling stock (1).

7. Method in accordance with claim 1, wherein the aperture width of the spray jet orifice is adjusted to allow further shaping of the water curtain.

8. Method in accordance with claim 1, wherein water jets (4, 5) are sprayed onto the strip (1) on the run-in side as small a distance as possible before the roll gap with a jet direction against the strip flow direction.

9. Equipment for cooling and/or lubricating work rolls (2, 3) of a rolling stand, and rolling stock (1) passed between the rolls during the rolling operation, with the use of water in the form of spray jets (4, 5) as the cooling medium and with the use of a lubricant (10, 10'), especially for carrying out the method in accordance with claim 1, wherein the water and lubricant are assigned separate reservoirs and separate lines to application devices (11, 11', 11") for water (4, 5) and application devices (12, 12') for lubricant (10, 10'), wherein lubricant (10, 10') sprayed onto the roll is confined in a shielding shell (16, 16') and is drained off to the rear or to the side, and a discharge line (18, 18') is provided to allow reprocessing or disposal of lubricant separately from other cooling media.

10. Equipment in accordance with claim 9, wherein a lubricant spray device (12) for the upper roll (3) is placed above a wiper (9), and a lubricant spray device (12') for the lower roll (2) is placed below a wiper (8), and deflection plates (13, 14) or water distribution plates for the water spray jets (4, 5), which are directed towards the rolling stock (1), are installed, one below the upper wiper (9) on the run-in side, and the other above the lower wiper (8) on the run-in side.

11. Equipment in accordance with claim 10, wherein two deflection plates (13, 14) are provided, which focus the coolant jet (4, 5) like a funnel in such a way that the uniformity of the coolant jet over the width of the rolling stock (1) is further improved.

12. Method for controlling the cooling and/or lubrication of rolls (2, 3) of a rolling stand and rolling stock (1) passed between the rolls during the rolling operation, with the use of water spray jets (4, 5) as the cooling medium and with the use of a lubricant (10, 10'), wherein the roll cooling system (11") on the run-in side is deactivated during active lubrication, and the roll cooling system (11") is activated when the lubrication is not active, and that, when the roll cooling system on the run-in side is deactivated, excess water from the run-in side is used to intensify the cooling of the rolls on the run-out side.

* * * * *